US008348086B2

(12) United States Patent
Apps

(10) Patent No.: US 8,348,086 B2
(45) Date of Patent: Jan. 8, 2013

(54) PLASTIC BEER KEG

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 339 days.

(21) Appl. No.: 12/763,491

(22) Filed: Apr. 20, 2010

(65) Prior Publication Data

US 2010/0264140 A1 Oct. 21, 2010

Related U.S. Application Data

(60) Provisional application No. 61/170,972, filed on Apr. 20, 2009.

(51) Int. Cl.

| | |
|---|---|
| ***B65D 21/02*** | (2006.01) |
| ***B65D 21/00*** | (2006.01) |
| ***B65D 25/14*** | (2006.01) |
| ***B65D 1/32*** | (2006.01) |
| ***B65D 41/00*** | (2006.01) |
| ***B65B 7/28*** | (2006.01) |

(52) U.S. Cl. ..... 220/592.19; 220/23.89; 220/200; 220/495.03; 220/592.01; 220/592.16; 220/592.18; 220/601; 220/723; 206/511; 206/514

(58) Field of Classification Search ..... 220/23.89, 220/200, 495.03, 592.01, 592.16, 592.17, 220/592.18, 592.19, 601, 672, 675, 723, 220/DIG. 1; 206/511, 514, 519

See application file for complete search history.

(56) References Cited

U.S. PATENT DOCUMENTS

| | | | | |
|---|---|---|---|---|
| 3,140,007 | A * | 7/1964 | Nettleship | 206/508 |
| 3,825,145 | A | 7/1974 | Reynolds | |
| 3,827,595 | A | 8/1974 | Reynolds | |
| 3,908,871 | A | 9/1975 | Gottwald | |
| 3,952,904 | A | 4/1976 | Verlinden | |
| 4,032,047 | A | 6/1977 | Wilson | |
| 4,482,067 | A | 11/1984 | Saito et al. | |
| 4,491,247 | A | 1/1985 | Nitchman | |
| 4,519,219 | A | 5/1985 | Prepodnik et al. | |
| 4,531,656 | A | 7/1985 | Nitchman | |
| 4,867,348 | A | 9/1989 | Dorfman | |
| 5,129,534 | A | 7/1992 | Dunn | |
| 5,267,669 | A | 12/1993 | Dixon et al. | |
| 5,597,085 | A | 1/1997 | Rauworth et al. | |

(Continued)

FOREIGN PATENT DOCUMENTS

EP 1 095 897 A1 5/2001

(Continued)

OTHER PUBLICATIONS

Notification Concerning Transmittal of International Preliminary Report on Patentability for PCT/US2010/031704 mailed on Nov. 3, 2011.

(Continued)

*Primary Examiner* — Anthony Stashick
*Assistant Examiner* — Madison L Poos
(74) *Attorney, Agent, or Firm* — Carlson, Gaskey & Olds

(57) ABSTRACT

A beer keg includes a container having a base and a wall extending upward from a periphery of the base. A liner within the container includes a base, sidewalls and a mouth. The base of the liner interlocks with the base of the container to prevent relative rotation therebetween. A valve is disposed over the mouth of the liner.

14 Claims, 8 Drawing Sheets

U.S. PATENT DOCUMENTS

| | | | | |
|---|---|---|---|---|
| 5,897,016 | A | 4/1999 | Wheaton | |
| 6,196,277 | B1 | 3/2001 | Till et al. | |
| 6,260,823 | B1 | 7/2001 | Weber | |
| 6,308,858 | B1 | 10/2001 | Koefelda | |
| 6,343,916 | B1 | 2/2002 | Bougamont et al. | |
| 6,415,959 | B1 | 7/2002 | Bougamont et al. | |
| 6,626,314 | B1 | 9/2003 | McHenry et al. | |
| 6,666,358 | B1 | 12/2003 | Field | |
| 6,748,789 | B2 | 6/2004 | Turner et al. | |
| 6,751,981 | B1 | 6/2004 | Burnette | |
| 6,805,267 | B2 | 10/2004 | Bougamont et al. | |
| 7,134,578 | B2 | 11/2006 | Bougamont et al. | |
| 7,174,762 | B2 | 2/2007 | Turner et al. | |
| 7,455,082 | B2 | 11/2008 | Monzel | |
| 7,546,935 | B2 | 6/2009 | Wheaton | |
| 7,819,286 | B2 * | 10/2010 | Antheil et al. | 222/105 |
| 2004/0026461 | A1 | 2/2004 | Bougamont et al. | |
| 2006/0049213 | A1 | 3/2006 | Wheaton | |
| 2008/0251542 | A1 | 10/2008 | Rossignol | |
| 2008/0277001 | A1 | 11/2008 | Wheaton | |
| 2009/0206505 | A1 | 8/2009 | Monzel et al. | |
| 2009/0320264 | A1 | 12/2009 | Berger et al. | |
| 2010/0077790 | A1 | 4/2010 | Apps | |
| 2011/0017737 | A1 | 1/2011 | Apps | |
| 2011/0180535 | A1 | 7/2011 | Apps | |

FOREIGN PATENT DOCUMENTS

| | | | |
|---|---|---|---|
| EP | 1270499 | | 1/2003 |
| EP | 1 947 029 | | 7/2008 |
| EP | 2281753 | | 2/2011 |
| FR | 2 665 688 | A1 | 2/1992 |
| GB | 437 295 | | 10/1935 |
| GB | 2 182 319 | A | 5/1987 |
| GB | 2188040 | | 9/1987 |
| GB | 2209740 | | 5/1989 |
| GB | 2283967 | | 5/1995 |
| WO | 91/12196 | | 8/1991 |
| WO | 2004063087 | | 7/2004 |
| WO | 2006110948 | | 10/2006 |
| WO | 2008/013819 | A2 | 1/2008 |
| WO | WO 2008/013819 | A2 * | 1/2008 |
| WO | 2008083782 | | 7/2008 |

OTHER PUBLICATIONS

International Search Report for PCT Application No. PCT/US2010/031704, Sep. 24, 2010.

* cited by examiner

PLASTIC BEER KEG

This application claims priority to U.S. Provisional Application Ser. No. 61/170,972, filed Apr. 20, 2009.

BACKGROUND OF THE INVENTION

The present invention relates generally to large multiple serving beverage containers, in particular, beer kegs.

Metal beer kegs primarily made of stainless steel have been the preferred method of transporting draft beer from the brewery to the retailer (i.e. restaurant, bar, store) for many years. They come in several sizes, between a sixth barrel and a half barrel.

Metal kegs are very durable and can give many years of service. However, they have a high initial purchase price and several additional costs during use. First, shipping an empty keg back to the brewery increases the actual cost of using stainless steel or metal beer kegs. Next, the keg must be prepared for refilling, including being emptied, inspected, pressure checked, precleaned with water, cleaned with a caustic rinse, steam sterilized and evacuated with $CO_2$ before it can be refilled. Damaged kegs must also be repaired as needed at this time.

The high cost of stainless steel has made it profitable for thieves to steal empty kegs and sell them for scrap. The cost of lost or stolen kegs further increases the cost of using metal beer kegs.

SUMMARY

A beer keg includes a container having a base and a wall extending upward from a periphery of the base. A liner within the container includes a base, sidewalls and a mouth. The base of the liner interlocks with the base of the container to prevent relative rotation therebetween. A valve is disposed over the mouth of the liner.

According to a method according to another aspect of the invention, the liner is pressurized with a gas before being filled with the liquid (beer). This internal pressure provides increased strength to the liner. The internal pressure may also assist in retaining the liner within the container, especially when inverted.

DETAILED DESCRIPTION OF THE PREFERRED EMBODIMENTS

Figure 1:
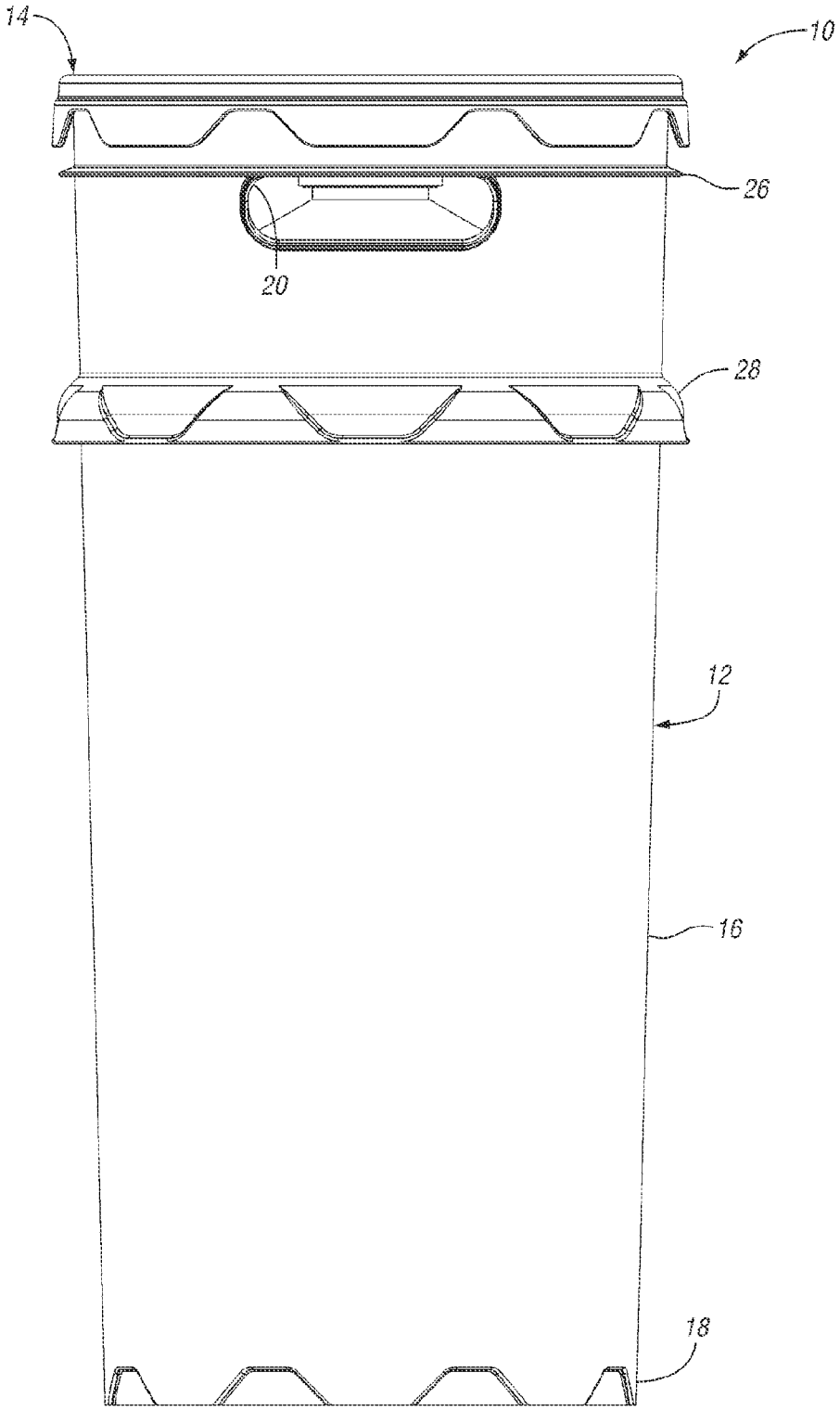
FIG. 1 is a side view of a beer keg according to one embodiment of the present invention.

FIG. 1 illustrates a plastic one-way beer keg 10 according to one embodiment of the present invention. The plastic beer keg 10 includes an outer container 12 having a removable lid 14. The outer container 12 has an outer wall 16 extending upward from a periphery of a base 18. The plastic beer keg 10 is symmetric, such that the side not in view of FIG. 1 is symmetric to that of FIG. 1.

The wall 16 includes a pair of handle openings 20 extending through an upper portion of the outer wall 16. An annular rib 26 extends outward from the outer wall 16 above the handle openings 20 to increase the rigidity of the container mouth. An annular skirt 28 extends outward from the outer wall 16 below the handles 20 to increase the rigidity of the outer wall 16 and to provide additional grip points.

It should be noted that the container 12 is generally in the form of a pail, which provides several advantages as will be described below. It should be noted that, in general, the familiar form factor of the pail with removable lid provides many of the advantages of the present invention beer keg 10, including nestability of the containers 12 with one another, ease of carrying, removability and replacability of the lid 14, and reusability of the container 12 and lid 14. This also provides advantages to the extent that there are existing technologies for the manufacture, labeling and handling of pails generally. The container 12 and lid 14 may be HDPE, polypropylene or other suitable materials.

Figure 2:
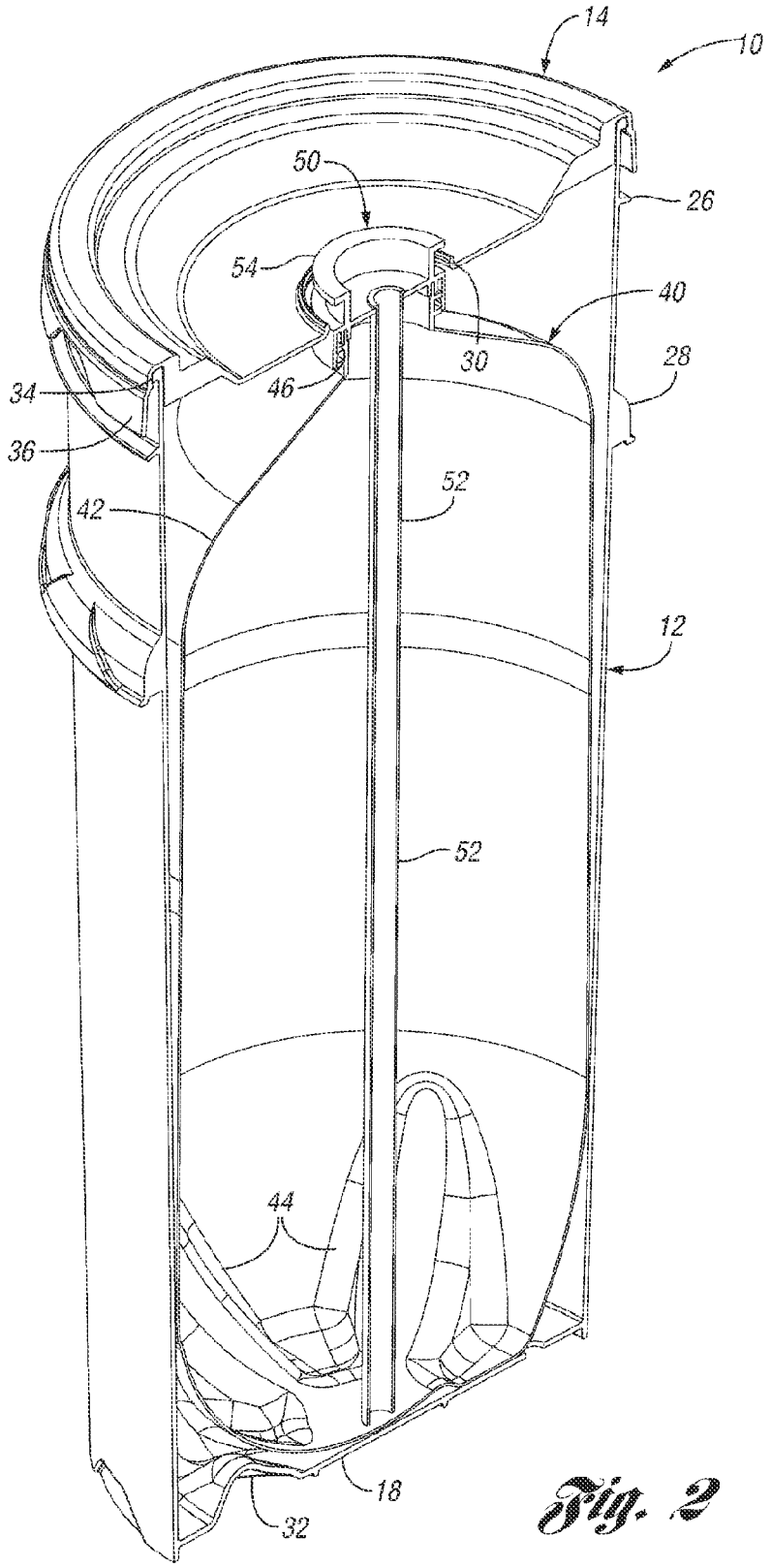
FIG. 2 is a perspective view of the beer keg of FIG. 1, with half broken away.
Figure 3:
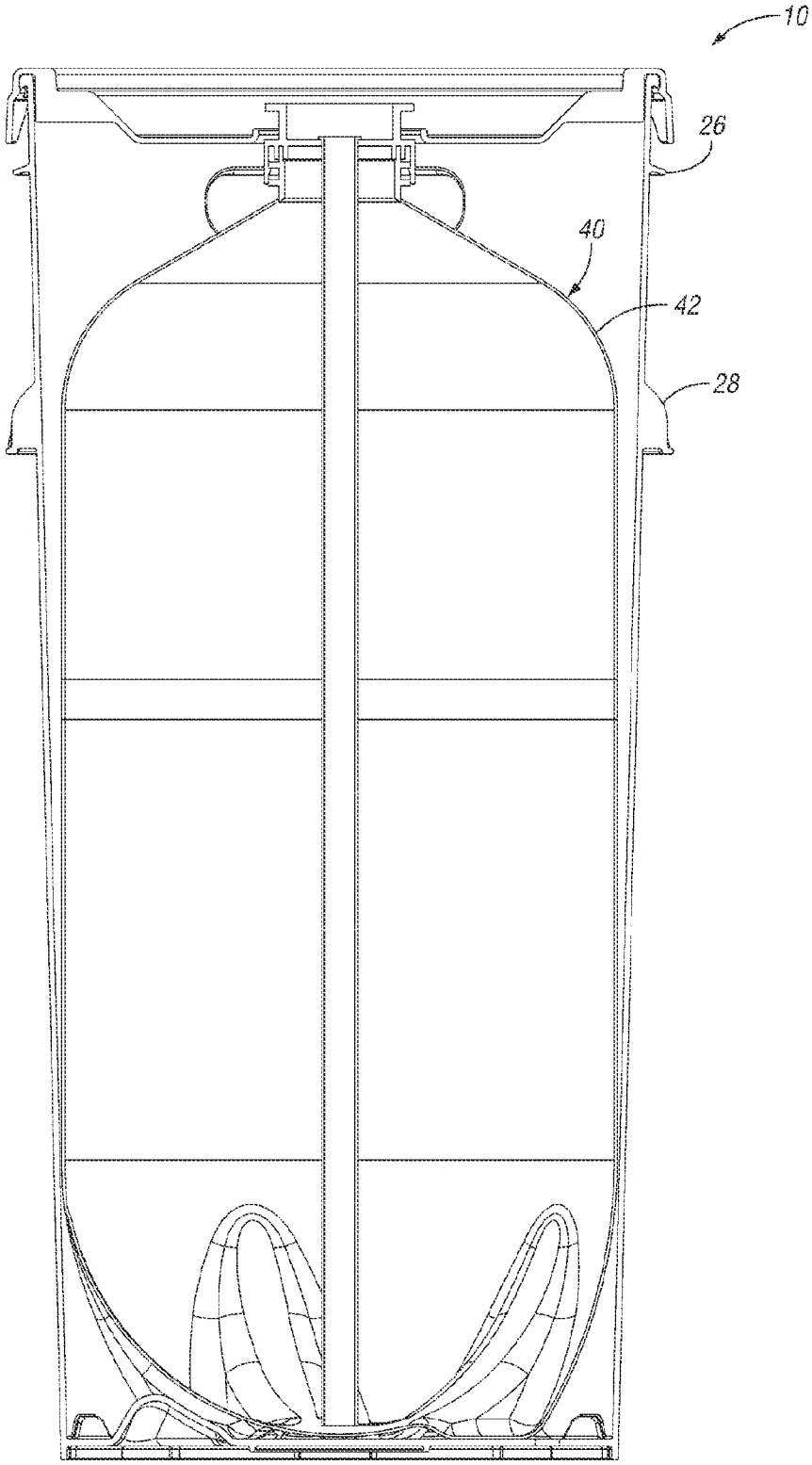
FIG. 3 is a side section view of the beer keg of FIG. 1.

FIGS. 2 and 3 illustrate the beer keg 10 of FIG. 1 partially broken away. A liner 40 (or "bottle") has an outer wall 42, which generally matches the shape of the interior of the container 12. The liner 40 may be blow-molded PET or other suitable material. As is known with PET beverage bottles, the liner 40 is provided with a base having a plurality of feet 44, to make the liner stable for stacking, shipping and conveying. The mouth 46 of the liner 40 is aligned with an opening 30 through the lid 14. The feet 44 of the liner 40 rest on the base wall 18 of the container 12. The base 18 of the container 12 includes corrugations 32 that interlock with the feet 44 of the liner 40. The lid 14 is shown as having a snap-on fit with the outer container 12, but a threaded attachment between the lid 14 and the outer wall 16 could also be used. The lid 14 has an outer annular wall, or lip, 36 that is radially outward of the upper edge 34 of the container 12.

A valve/spear assembly 50 is secured to the mouth 46 of the PET bottle 40. The valve/spear assembly 50 includes a spear 52 extending downwardly to the bottom of the liner 40 from a valve 54 at the liner 40 mouth 46. The valve 54 and spear 52 are not shown in detail.

Figure 4:
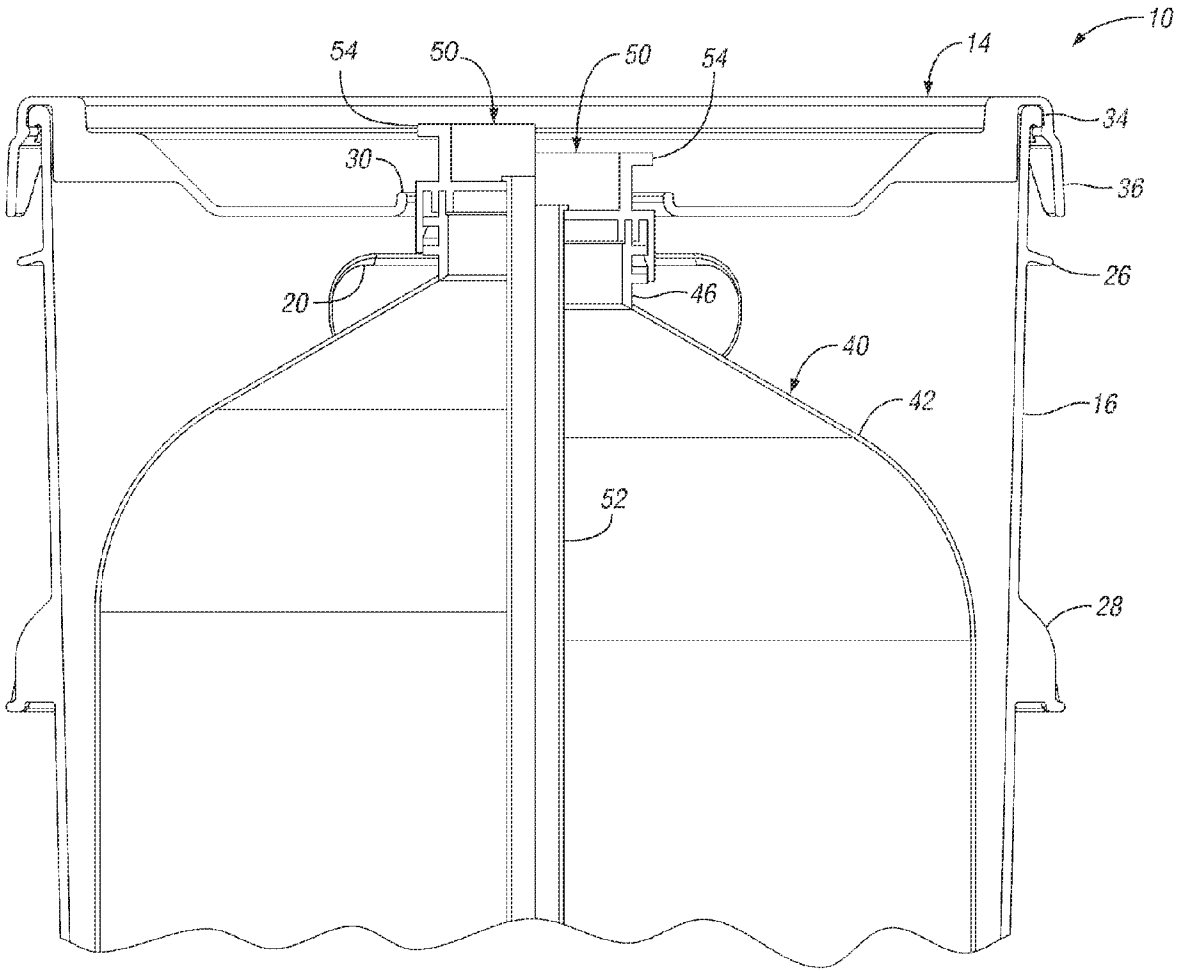
FIG. 4 is an enlarged view of the upper portion of FIG. 3, showing the top of the liner in both the expanded and unexpanded positions.
Figure 5:
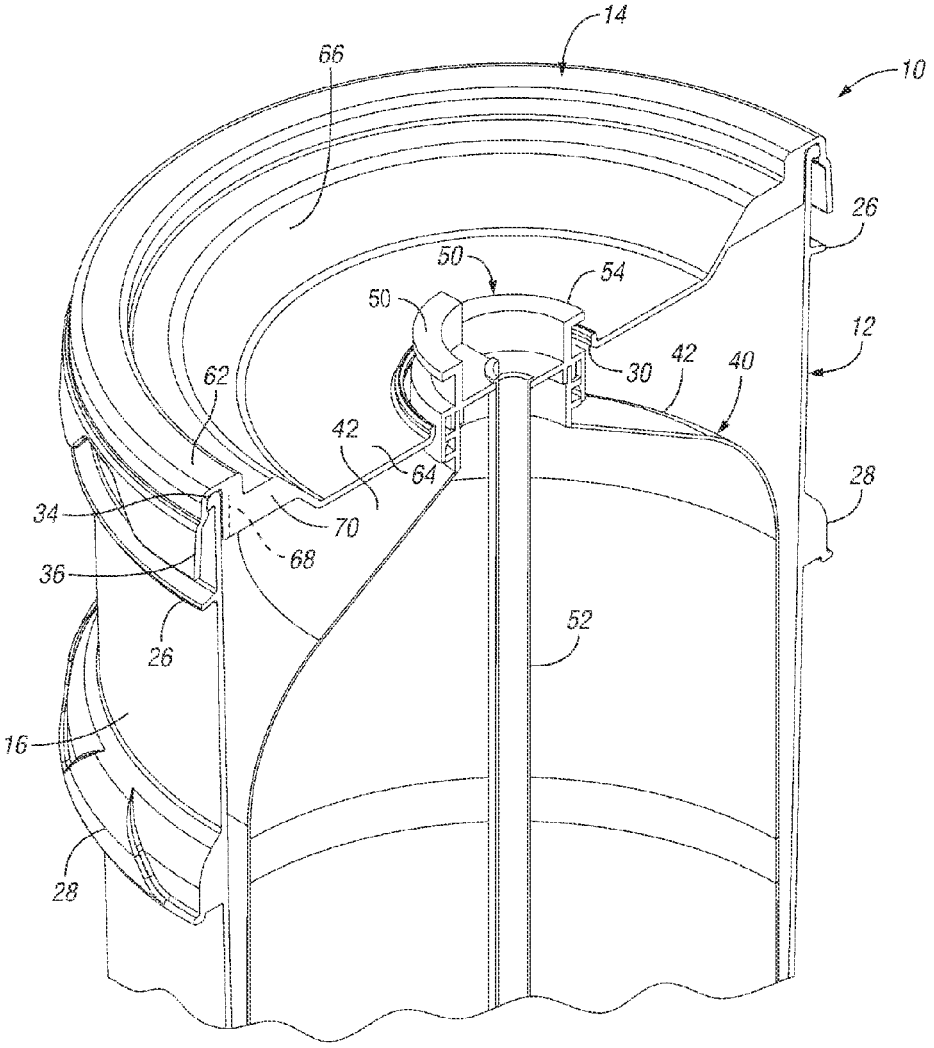
FIG. 5 is a side view of the keg of FIG. 4.

In FIGS. 4 and 5, the right side of the drawing shows the liner 40 in its initial state in the outer container 12, while the left side of the drawing shows the liner 40 in its pressurized state after being filled with a carbonated beverage. As shown, the liner 40 expands when pressurized. The lid 14 is angled downwardly to the opening around the valve 54. The opening 30 in the lid 14 permits the liner 40 to expand without the liner 40 contacting the lid 14. At either height, the valve 54 is below the height of the outer wall 16 of the outer container 12 to protect the valve 54 and above the height of the lid 14 to keep the valve 54 in the proper location. There is also sufficient room to place a removable cap (not shown) over the valve 54.

Referring to FIG. 5, the lid 14 includes an annular outer portion 62 over the upper edge 34 of the wall 16 of the container 12 and an annular inner portion 64 within the annular outer portion 62. The annular inner portion 64 is offset downwardly from the annular outer portion 62. The opening 30 is formed through the annular inner portion 64. The lid 14 also includes an annular angled portion 66 extending between the annular outer portion 62 and the annular inner portion 64. The lid 14 includes an annular inner wall 68 adjacent an interior surface of the wall 16 of the container 12. A plurality of radial ribs 70 on a lower surface of the lid 14 connect the annular inner wall 68 to the annular angled portion 66.

Figure 6:
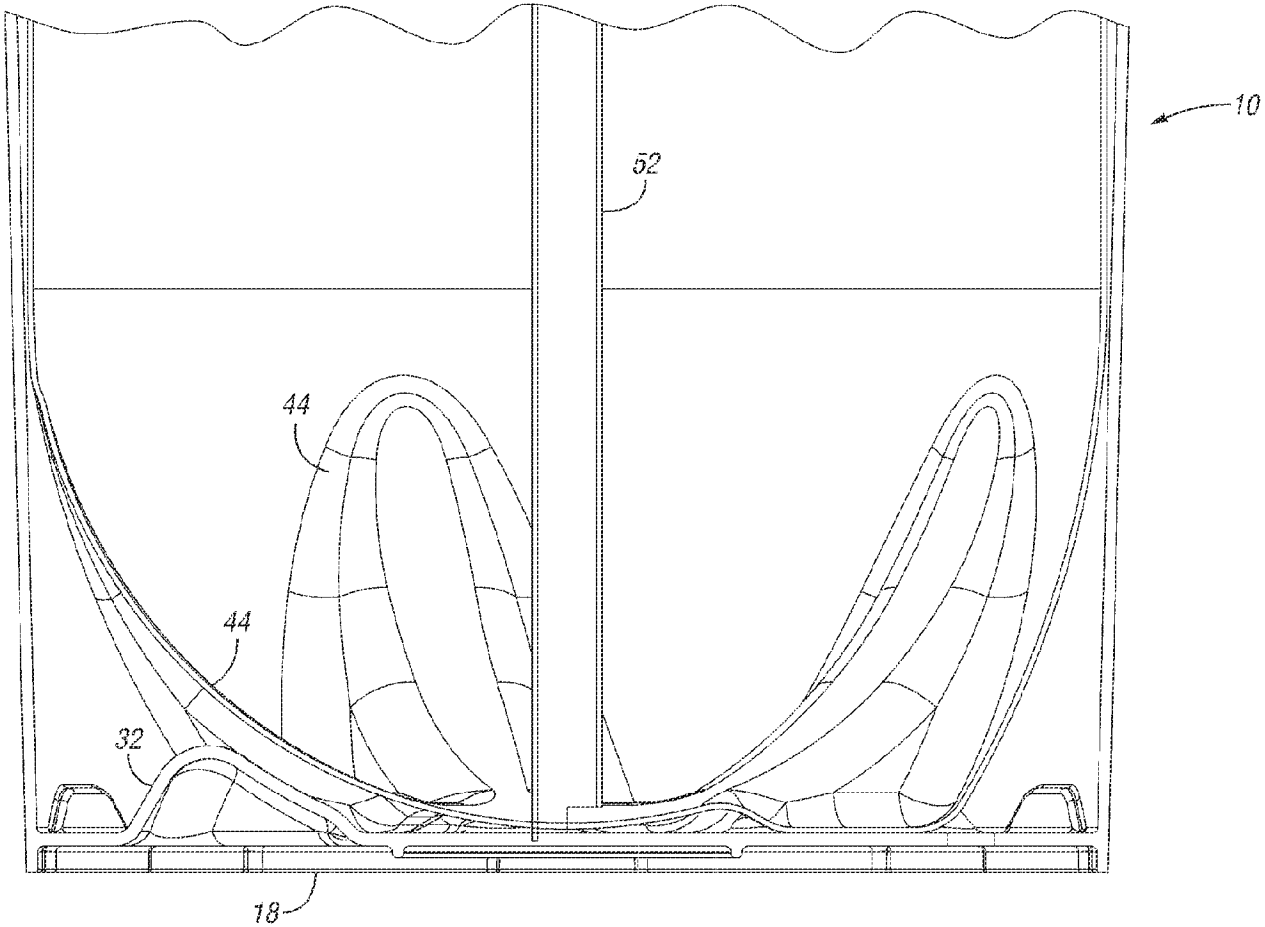
FIG. 6 is an enlarged view of the bottom portion of the container.
Figure 7:
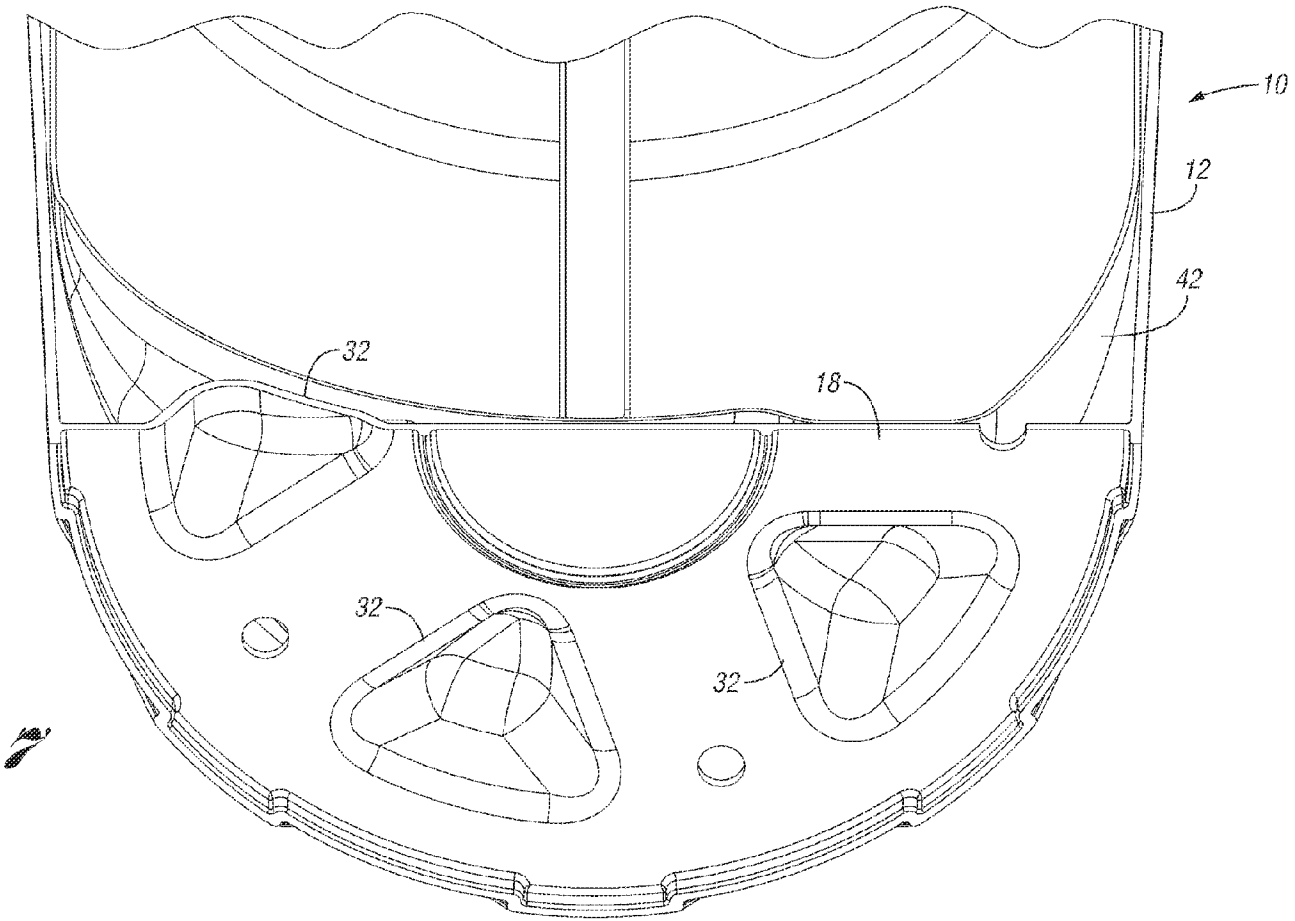
FIG. 7 a perspective view of the underside of the container of FIG. 1, with half broken away.

In FIGS. 6 and 7, it is shown that the feet 44 interlock with the corrugations 32 in the bottom wall 18 of the outer container 12. This prevents relative rotation between the liner 40 and the outer container 12 during tapping of the keg 10.

Figure 8:
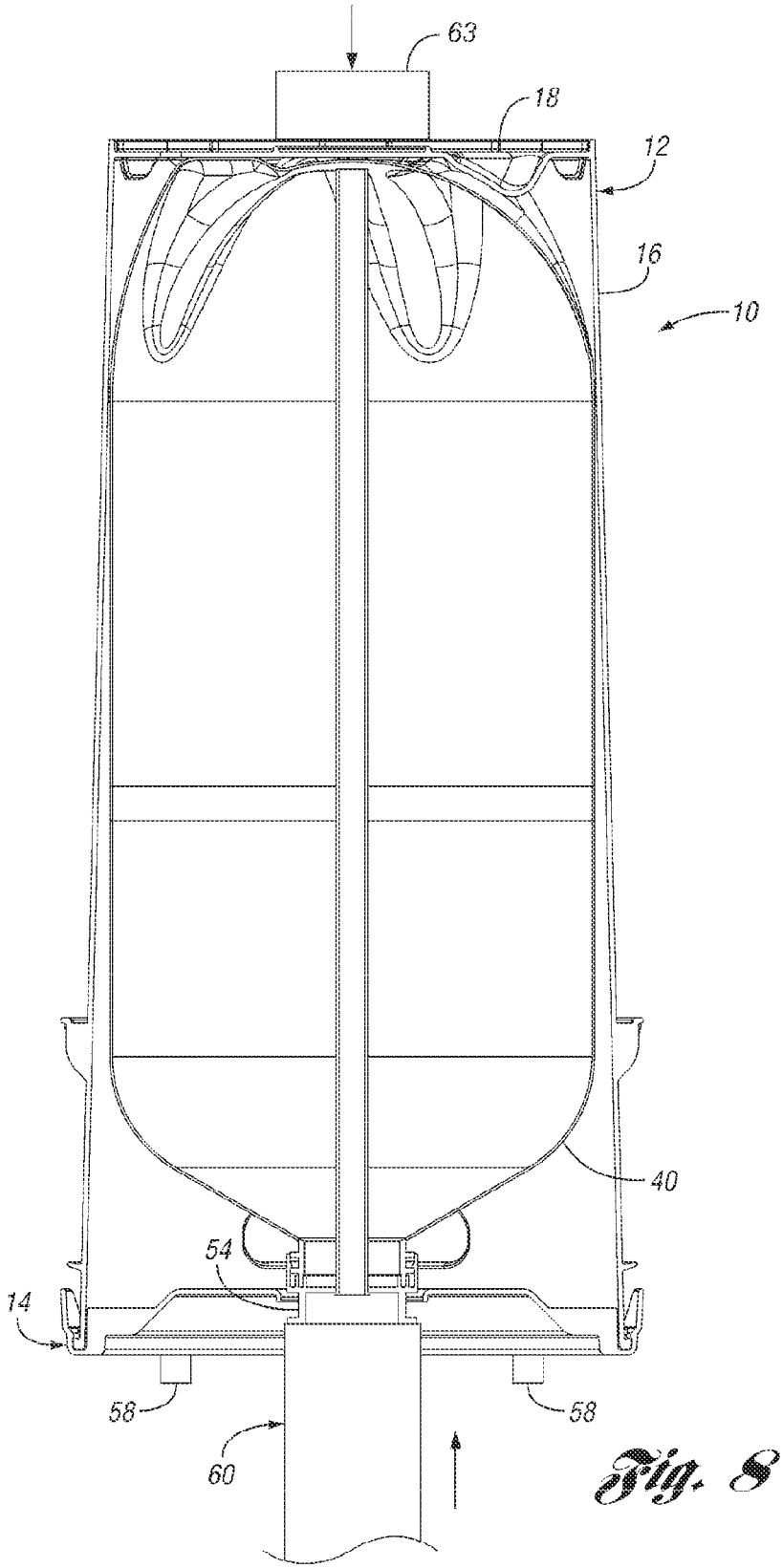
FIG. 8 is a section view of the liner and container of FIG. 1 being filled under pressure.

FIG. 8 illustrates one method for filling the keg 10. The keg 10 is filled in the inverted orientation as shown. The liner 40, after being formed, it pressurized with CO2 (or other suitable fluid) before or after being inserted in the outer container 12. This expands the liner 40 sufficiently that the liner 40 bears against the outer wall 16. The lid 14 is secured to the mouth of the outer container 12. The pressure in the liner 40 is sufficient to hold the liner 40 inside the outer container 12 when inverted. The empty inverted keg 10 is placed on rails 58. The filling valve 60 rises to engage the valve 54, while an upper clamp 63 bears down on the bottom wall 18 of the outer container 12. If the liner 40 does slide down when inverted, the filling valve 60 lifts it up against the bottom wall 18. The pressure inside the liner 40 also assists the liner 40 to withstand the clamping force between the upper clamp 63 and the filling valve 60. Optionally, the neck of the liner 40 could be corrugated to increase strength.

The liner 40 is then filled by the filling valve 60. The filling valve 60 then lowers again. The liner 40 when full is pressurized and expanded against the outer wall 16 of the outer container 12. The friction between the liner 40 and outer wall 16 holds the liner 40 in the outer container 12 even when the liner 40 is full. Optionally, portions of the outer wall 16 could be made with a smaller inner diameter to increase the friction between the liner 40 and outer wall 16 after the liner 40 is pressurized. The filled keg 10 is then turned back to the upright position for shipping, sale and use.

Prior to filling, and after removal of an empty liner 40 by the user, empty containers 12 can be nested within one another, thus reducing their overall stacking height. Further, the lids 14 are also stackable and partially nestable. The used liners 40 and valve/spear assemblies 50 can be recycled. The empty outer containers 12 can be returned to be used with new liners 40, or recycled. The empty outer containers 12 can also be reused for other purposes.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method claim steps are for ease of reference in dependent claims and do not signify a required sequence unless otherwise specified.

What is claimed is:

1. A plastic beer keg including:

a container having a base and a wall extending upward from a periphery of the base;

a liner within the container, the liner including a base, sidewalls and a mouth;

a valve disposed over the mouth of the liner; and a removable lid secured to an upper edge of the wall of the container, the lid enclosing the liner, the lid including an annular outer portion over the upper edge of the wall of the container and an annular inner portion within the annular outer portion, the annular inner portion offset downwardly from the annular outer portion, an opening formed through the annular inner portion, the lid further including an annular angled portion extending between the annular outer portion and the annular inner portion.

2. The plastic beer keg of claim 1 wherein the base of the container includes at least one corrugation for interlocking with the base of the liner.

3. The plastic beer keg of claim 1 wherein the base of the liner includes a plurality of feet interlocking with the base of the container.

4. The plastic beer keg of claim 3 wherein the base of the container includes at least one corrugation for interlocking with feet on the base of the liner.

5. The plastic beer keg of claim 1 wherein the lid includes a plurality of radial ribs on a lower surface thereof adjacent the annular outer portion and the annular angled portion.

6. The plastic beer keg of claim 5 wherein the plurality of radial ribs are adjacent the wall of the container.

7. The plastic beer keg of claim 1 wherein the liner is expandable under pressure such that the valve would move upwardly in an opening through a lid secured to an upper edge of the wall of the container.

8. The plastic beer keg of claim 1 wherein the liner is made of polyethylene terephthalate (PET).

9. The plastic beer keg of claim 1 wherein the wall of the container is tapered such that the container is nestable with a similar container when empty.

10. The plastic beer keg of claim 1 wherein the lid includes an annular inner wall adjacent an interior surface of the wall of the container.

11. The plastic beer keg of claim 10 wherein the lid includes a plurality of radial ribs on a lower surface thereof, the radial ribs connecting the annular inner wall to the annular angled portion.

12. The plastic beer keg of claim 1 wherein the base of the liner interlocks with the base of the container to prevent relative rotation therebetween.

13. A plastic beer keg including:

a container having a base and a wall extending upward from a periphery of the base;

a liner within the container, the liner including a base, sidewalls and a mouth, the base of the liner interlocking with the base of the container to prevent rotation therebetween, wherein the liner contains only a gas pressurized above atmosphere; and a valve disposed over the mouth of the liner.

14. The plastic beer keg of claim 13 wherein the liner is expanded by the pressurized gas to bear against an inner surface of the wall of the container.

* * * * *

UNITED STATES PATENT AND TRADEMARK OFFICE

CERTIFICATE OF CORRECTION

PATENT NO. : 8,348,086 B2
APPLICATION NO. : 12/763491
DATED : January 8, 2013
INVENTOR(S) : Apps It is certified that error appears in the above-identified patent and that said Letters Patent is hereby corrected as shown below:

IN THE CLAIMS:

Claim 7, column 4, line 27; delete "a" and replace with the --the--

Signed and Sealed this
Ninth Day of September, 2014

Michelle K. Lee

Michelle K. Lee
*Deputy Director of the United States Patent and Trademark Office*